US008677791B2

(12) United States Patent
Piotrowski et al.

(10) Patent No.: US 8,677,791 B2
(45) Date of Patent: Mar. 25, 2014

(54) LOCKING ARRANGEMENT COMPRISING A LOCK CYLINDER AND A MATCHING KEY

(75) Inventors: Theo Piotrowski, Kerpen (DE); Michael Reine, Essen (DE)

(73) Assignee: C. Ed. Schulte Gesellschaft Mit Beschraenkter Haftung Zylinderschlossfabrik, Velbert (DE)

( * ) Notice: Subject to any disclaimer, the term of this patent is extended or adjusted under 35 U.S.C. 154(b) by 134 days.

(21) Appl. No.: 12/893,290

(22) Filed: Sep. 29, 2010

(65) Prior Publication Data

US 2011/0079059 A1 Apr. 7, 2011

(30) Foreign Application Priority Data

Oct. 2, 2009 (DE) ..... 10 2009 044 170

(51) Int. Cl.
*E05B 63/00* (2006.01)
*E05B 27/06* (2006.01)

(52) U.S. Cl.
USPC ..... 70/421; 70/356; 70/406; 70/493

(58) Field of Classification Search
USPC ..... 70/356, 358, 402, 405, 406, 409, 70/419–421, 493
See application file for complete search history.

(56) References Cited

U.S. PATENT DOCUMENTS 2,857,753 A * 10/1958 Biro ..... 70/493
4,231,242 A * 11/1980 Hill et al. ..... 70/493
5,079,936 A * 1/1992 Stefanek ..... 70/493
5,475,998 A * 12/1995 Raskevicius et al. ..... 70/493
5,819,566 A * 10/1998 Eden, Jr. ..... 70/493
5,823,029 A * 10/1998 Eden et al. ..... 70/493
6,526,791 B2 * 3/2003 Shvarts ..... 70/493
7,040,126 B2 * 5/2006 Edwards, Jr. ..... 70/492
RE39,364 E * 10/2006 Brandt ..... 70/493
2010/0212383 A1 * 8/2010 Stuart ..... 70/493

FOREIGN PATENT DOCUMENTS

DE 2738313 A1 1/1979
DE 3010418 A1 9/1981

* cited by examiner

*Primary Examiner* — Christopher Boswell

(74) *Attorney, Agent, or Firm* — Lucas & Mercanti, LLP; Klaus P. Stoffel

(57) ABSTRACT

A locking arrangement with a lock cylinder and matching key. The key has a flat key bit with a narrow spine, two broad sides, and coding notches at coding positions on the key bit. The cylinder has a housing, core, tumblers, and a sensing member located in a supplementary core hole. Spacing from the spine of the sensing point is greater than spacing from the spine of the apex of the notch is cut the deepest. The sensing point is near a peripheral edge of a notch cut less such that deepening the notch to a depth of the notch cut the deepest leads to disappearance of the sensing point. For protection against unlocking, the supplementary core hole is located between adjacent core holes and the sensing member has a tip which the sensing point on a broad side of the key situated between adjacent coding positions is sensed.

10 Claims, 6 Drawing Sheets

LOCKING ARRANGEMENT COMPRISING A LOCK CYLINDER AND A MATCHING KEY

This application is a 371 of DE 10 2009 044 107.0-15 filed Oct. 2, 2009, the priority of this application is hereby claimed and this application is incorporated by reference herein.

BACKGROUND OF THE INVENTION

The invention relates to a locking arrangement having a lock cylinder and a matching key; the key having a flat key bit with a narrow spine, two broad sides which run substantially parallel to one another, and coding notches on the front, which is opposite the spine, at coding positions on the key bit; the lock cylinder having a cylinder housing, a cylinder core which is mounted in a bearing hole in the cylinder housing and has a keyway for insertion of the key bit, tumblers which are located in core pin holes, interact with the coding notches on the key bit, and are disposed at coding positions on the cylinder, said coding positions coinciding with coding positions on the key bit when the locking bit is inserted as far as a stop in the keyway, and a sensing member which is located in a supplementary core hole that extends transversely relative to the core pin holes and senses a sensing point on a broad side of the key, the spacing, from the spine, of the sensing point on a broad side of the key being greater than the spacing, from the spine, of the apex of the coding notch that is cut-in to the deepest extent, the sensing point being situated close to a peripheral edge of a coding notch which is cut-in to a lesser extent than the coding notch that is cut-in to the deepest extent in such a way that deepening, of the coding notch which is cut-in to a lesser extent, to the depth of the coding notch that is cut-in to the deepest extent leads to disappearance of the sensing point. A locking arrangement of this kind is known from DE 27 38 313 C2.

The locking arrangement described there has core pins located in core holes, the core pins sensing the coding notches of a flat key. At the same axial level as one of the core pins, there are respective sensing members in supplementary core holes that run transverse to the core pin holes, the sensing members sensing the tip region of the core pins when the core pin enters the coding notch assigned to it. In the case of a key for which the notch depth of the coding notch is too small, the two sensing stub ends of the sensing member interact with a portion of the core pin of smaller diameter, so that they release blocking steps against which a housing pin engages when the cylinder core is rotated.

A further locking arrangement is described by U.S. Pat. No. 3,742,744. The key described in the document has a flat key bit, a narrow spine, a front which is opposite the spine, and two broad sides which run parallel to one another and are provided with profiled grooves and profiled ribs disposed between the profiled grooves. The key front is provided with a large number of coding notches cut-in to individual depths. Each of the coding notches has an apex. The apex is spaced from the spine of the locking bit. One of the apexes is at a minimum distance from the spine of the key bit. This is the coding notch that is cut-in to the deepest extent. The coding notches are spaced equally from one another and are situated at coding positions. The individual coding positions are equally spaced apart from one another. A sensing point, which is in the form of a recess and can be sensed by a supplementary tumbler pin that is mounted in a core hole, is also located on the broad side of the key. The distance by which the sensing point is spaced from the spine of the key corresponds substantially to the distance from the apex of the coding cutout that is cut-in to the deepest extent to the spine.

The associated lock cylinder has a housing, a core which can be rotated in a bearing hole in the housing, and a large number of tumblers. The tumblers are located in core holes and housing holes and are in the form of pins which prevent the core from rotating when a key is not inserted. The tumbler pins are equally spaced apart from one another in the core, in the direction of extent of a keyway, and are positioned at coding positions. If the matching key is inserted into the keyway as far as a stop position, the coding positions of the key bit coincide with the coding positions of the lock core, so that the tips of the core pins engage in the coding notches.

A customary method of opening such lock cylinders is the so-called bump key method in which keys are used, the coding notches of which are cut-in to the maximum possible depth. In principle, it suffices, for a bump key, to deepen the coding notches to a depth which corresponds to the depth of the coding notch of the proper key that is cut-in to the deepest extent.

SUMMARY OF THE INVENTION

In order to improve the protection of a lock cylinder of the generic type against unlocking using the bump key method, provision is made first and foremost for the spacing of the sensing point from the spine to be greater than the spacing, from the spine, of the apex of the coding notch that is cut-in to the deepest extent. The sensing point on a broad side of the key is then situated between two immediately adjacent coding positions and close to a peripheral edge of a coding notch in such a way that deepening of said coding notch to the same depth as that of the coding notch that is cut-in to the deepest extent leads to disappearance of the sensing point. The coding notch is usually produced using a grinding disk which has an angular grinding profile. If the coding notch which is adjacent to the sensing point is deepened using this grinding disk, the sensing point is ground away. Since the sensing point is situated between two coding positions, it is also situated between two tumbler pins. The supplementary tumbler pin which senses the sensing point can now not be held in the correct position by a portion of the broad side of the key. If this supplementary tumbler pin interacts with a supplementary housing pin, the supplementary housing pin cannot be moved out of a blocking position. The sensing point can be associated with a profiled rib. If the profiled rib is removed, the supplementary tumbler pin likewise cannot be held in the correct position. In a preferred refinement of the invention, provision is made for the sensing member to be a pin which is guided in a core hole, at least regions of the head of said pin being situated in an opening which can be moved to a position in which it is aligned with a housing-pin hole. When an attempt is made to open the lock cylinder according to the invention using the bump key method, the core pins which are situated in the coding notches and the housing pins which are associated with the core pins can be moved to a release position. As a result, the cylinder core can be rotated. Said cylinder core can be rotated up to the point where the core hole in which the supplementary tumbler is situated is moved to a position in which it is aligned with a housing hole. The housing pin can then enter the core hole, which is not filled or is at any rate partially filled by the head of the supplementary tumbler, under the action of the spring which is associated with said housing pin. If the opening in the supplementary core hole does not provide any bevels, the housing pin will be captured in the supplementary core hole.

The invention also relates to a lock cylinder for a locking arrangement, having a cylinder housing which has a cylinder core that is mounted in a bearing hole in the cylinder housing and has a keyway for insertion of a key bit of a key; core pins for entry into coding notches of the key bit, which are disposed at coding positions on the cylinder and are situated in core pin holes which are open to the bearing hole; and a sensing member for sensing a sensing point on a broad side of the key between two immediately adjacent core pins.

In order to achieve the object cited in the introductory part, provision is made, in the case of this lock cylinder, for the spacing of the tip of the sensing member from the opening in the bearing hole for the pin tumbler to be less than the length of the longest core pin. This results in the locking-related advantages described above.

The invention also relates to a key for the locking arrangement described above. The sensing point on a broad side of the key can be in the form of a recess in the broad side or a projection on the broad side.

BRIEF DESCRIPTION OF THE DRAWINGS

An exemplary embodiment of the invention will be explained below with reference to accompanying drawings, in which.

DETAILED DESCRIPTION OF THE INVENTION

Figure 1:
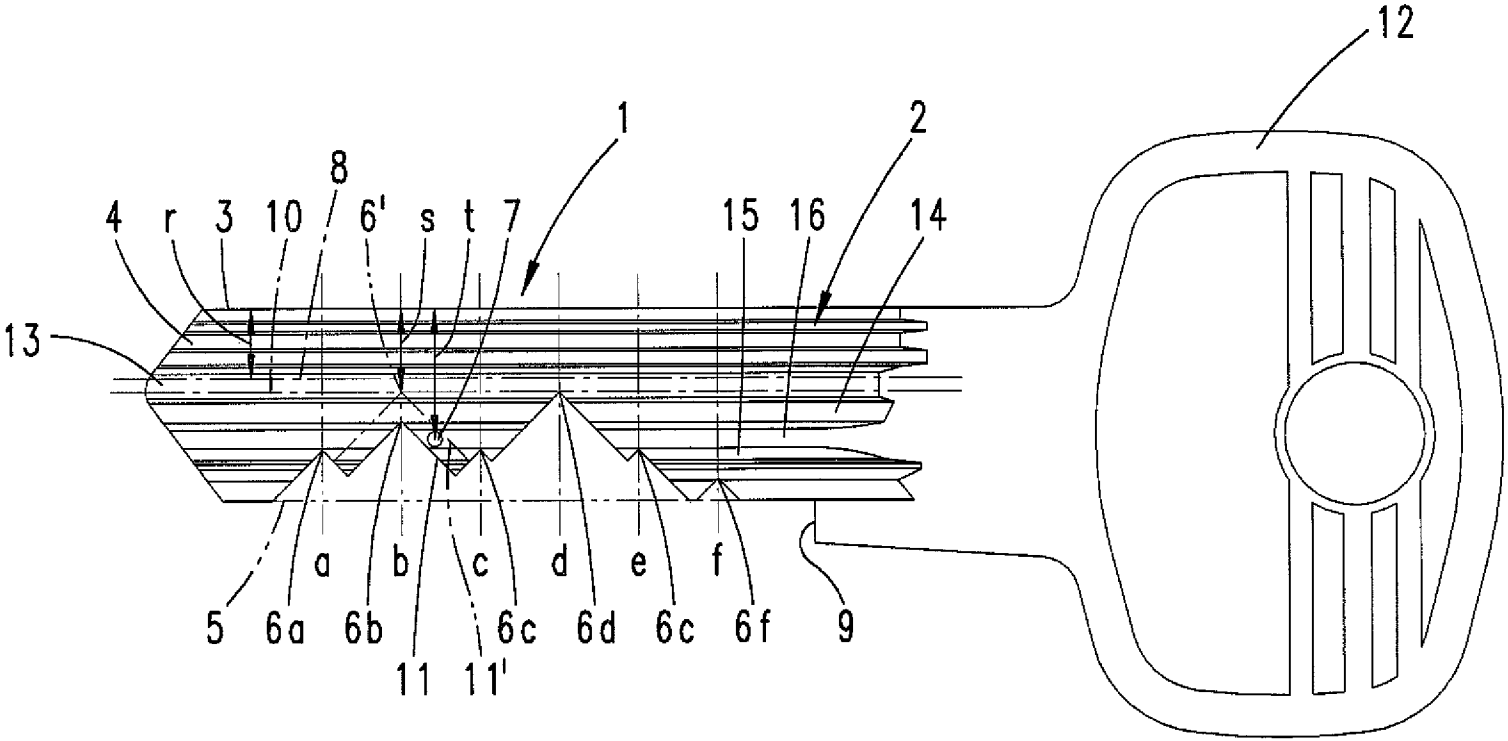
FIG. 1 shows a plan view of a key.
Figure 2:
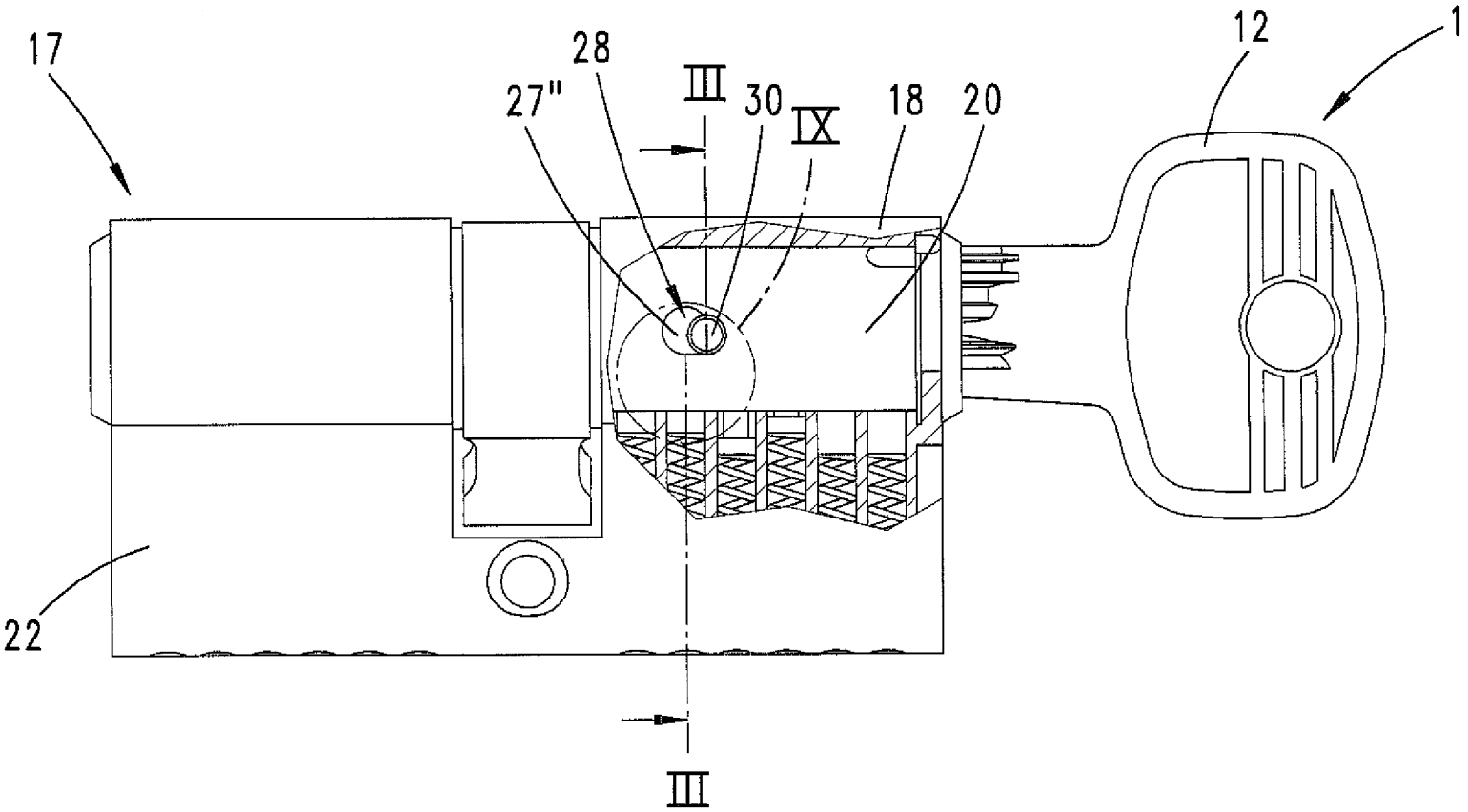
FIG. 2 shows a partially broken-away side view of a lock cylinder.
Figure 4:
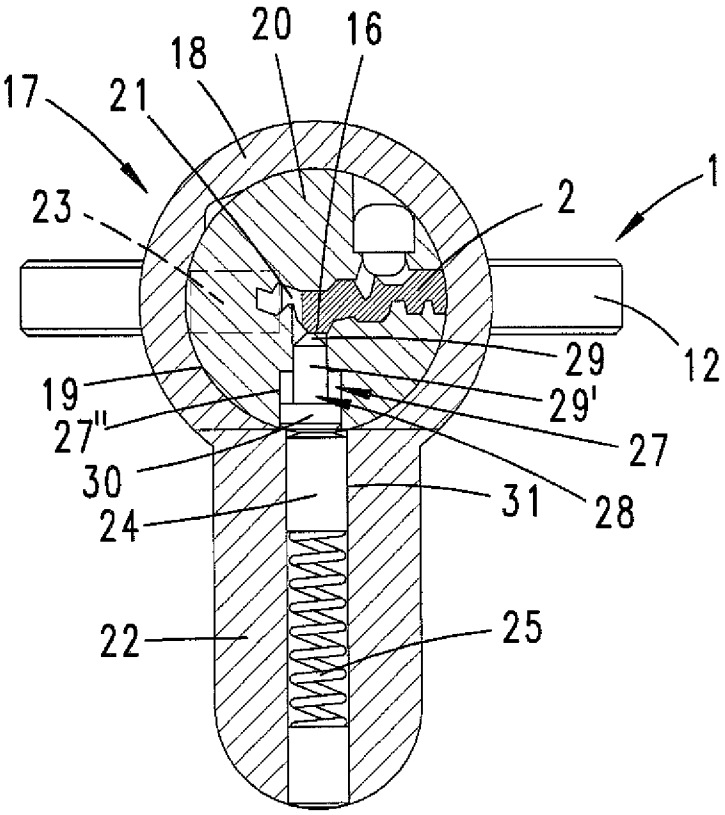
FIG. 4 shows an illustration according to FIG. 3 but with the cylinder core rotated through 90° in the clockwise direction.
Figure 3:
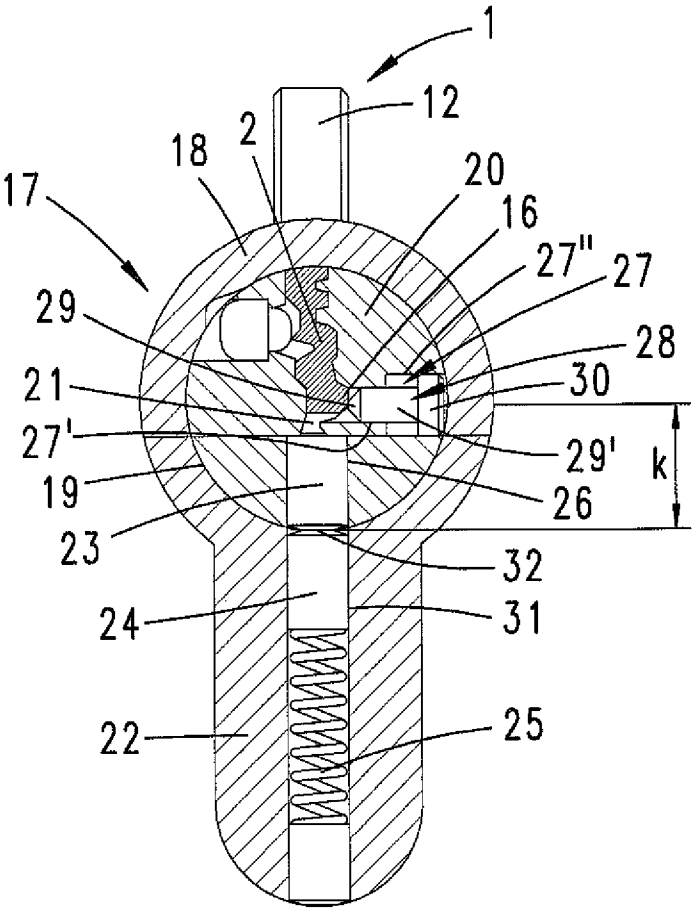
FIG. 3 shows a cross-section through the lock cylinder in accordance with line with a proper key inserted.

The key 1 illustrated in FIG. 1 has a bow 12 and a locking bit 2 projecting from the bow. The locking bit 2 has, in its direction of extent, at least two profiled grooves 14, 15 which run parallel to one another. A profiled rib 16 extends between the two profiled grooves 14, 15. The dashed line 8 indicates a spacing r from the spine 3 of the flat locking bit 2, it being possible for indented coding notches 6*a* to 6*f* to be cut into the front 5 of the key as far as said spacing. The apexes of the flanks of the coding notches 6*a* to 6*f*, which flanks can run obliquely to one another, are then situated at line 8 for the deepest possible notch.

A line 10 for the maximum notch depth for the individual key is illustrated parallel to line 8. At least one apex of a coding notch that is cut-in to the deepest extent is situated at said line 10, which is spaced from the spine 3 by the distance s. In the exemplary embodiment, this is the coding notch 6*d*.

The locking bit 2 has a total of six coding positions a to f. Other exemplary embodiments (not illustrated) may have more or fewer coding positions.

Reference numeral 7 denotes a sensing point which is situated on the broad side 4 of the locking bit 2. The sensing point 7 is not profiled in the exemplary embodiment. However, said sensing point may also be formed by a recess or a projection. The sensing point 7 is spaced from the spine 3 by the dimension t. The dimension t is greater than the dimension s which relates to the spacing, from the spine, of the apex of the coding notch 6*d* that is cut-in to the deepest extent. The sensing point 7 is situated between the coding positions b and c, that is to say between the two apexes of the coding notches 6*b* and 6*c*. The sensing point 7 is situated approximately in the middle between the two coding positions b and c. In any event, the sensing point 7 is situated closely adjacent to a peripheral edge 11 of the coding notch 6*b*. The coding notch 6*b* is cut-in to a lesser depth than the coding notch 6*d* that is cut-in to the deepest extent. Dashed lines and reference numeral 11' illustrate a subsequent deepening of the coding notch 6*b*. The sensing point 7 is situated between the peripheral edge 11 and a possible peripheral edge 11' which can be produced by deepening. If the coding notch 6*b* is deepened to the depth of the coding notch 6*d* of maximum depth, so that the apex of the coding notch 6*b* is spaced from the spine 3 by the dimension s, the sensing point 7 disappears. Said sensing point is removed when the coding notch 6*b* is ground down or milled.

In the exemplary embodiment, the sensing point 7 is situated on a profiled rib 16 which is interrupted by at least one coding notch. If only this profiled rib 16 is removed, the level of the sensing point 7 likewise changes.

The lock cylinder 17 has a housing 18 with a bearing hole 19 in which a cylinder core 20 is rotatably mounted. The cylinder core 20 has a keyway 21 into which the key bit 2 of the key 1 can be inserted, with the tip 13 leading, until the stop 9 of the key 1 butts against the end face of the cylinder core 20. At this point, the coding positions a to f of the key bit 2 coincide with the coding positions of the cylinder core 20. At these coding positions, the cylinder core has core holes 26 in which core pins 23 are situated. The flange portion 22 of the housing 18 has housing holes 31 which are aligned with the core holes 26 and in which core pins 24 are situated, said core pins being acted on by a spring 25 in the direction of the keyway 21.

Insertion of the appropriate key 1 into the keyway 21 results in the core pins 23, which are supported in the coding notches 6*a* to 6*f* by way of their tips, being sorted such that the end faces of said core pins are situated in the cylindrical lateral surface of the cylinder core 20, so that the cylinder core 20 can be rotated.

A supplementary tumbler pin 28 with a head 30 and a sensing tip 29 is located in a supplementary core hole 27 which extends transverse to the core pin holes 26. The shank 29', which extends between the sensing tip 29 and the head 30, is guided in a hole portion 27' of the core hole, which hole portion has a small diameter. The tip 29 is level with the sensing point 7. The supplementary tumbler pin 28 is therefore supported, by way of its sensing tip 29, on the rib 16 of the locking bit 2.

The supplementary core hole 27 is located between two core pin holes 26. The head 30 is located in a portion 27" of the core hole 27, which portion has an enlarged diameter. The head 30 has a round, enlarged cross-section, so that regions of said head project into the portion 27" of enlarged diameter, which portion can be moved to a position in which it is aligned with the housing-pin hole 31. If the end face of the head 30 is held in the cylindrical lateral plane of the cylinder core 20, that end face of the housing pin 24 which faces the cylinder core 20 slides over the end face of the head 30. For this, the tip 29 has to be supported on the sensing point 7.

The position of the radial hole 27, which extends transverse to the core pin hole 26, is at a spacing k from the opening 32 by which the core pin hole 26 opens into the bearing hole 19. The sum of the spacing dimensions k and t corresponds to the diameter of the cylinder core 20. There is at least one core pin 23 which is longer than the spacing dimension k.

In the case of a proper key being inserted into the keyway 21, the supplementary tumbler pin 28 is held in a correct position in which a portion of the outer face of the head 30 is situated in the cylindrical lateral plane of the cylinder core 20. If the cylinder core 20 is rotated, a region of the outer face of the head 30 slides across over the housing pin 24. The housing pin 24 cannot enter the portion 27" of the core hole 27.

Figure 6:
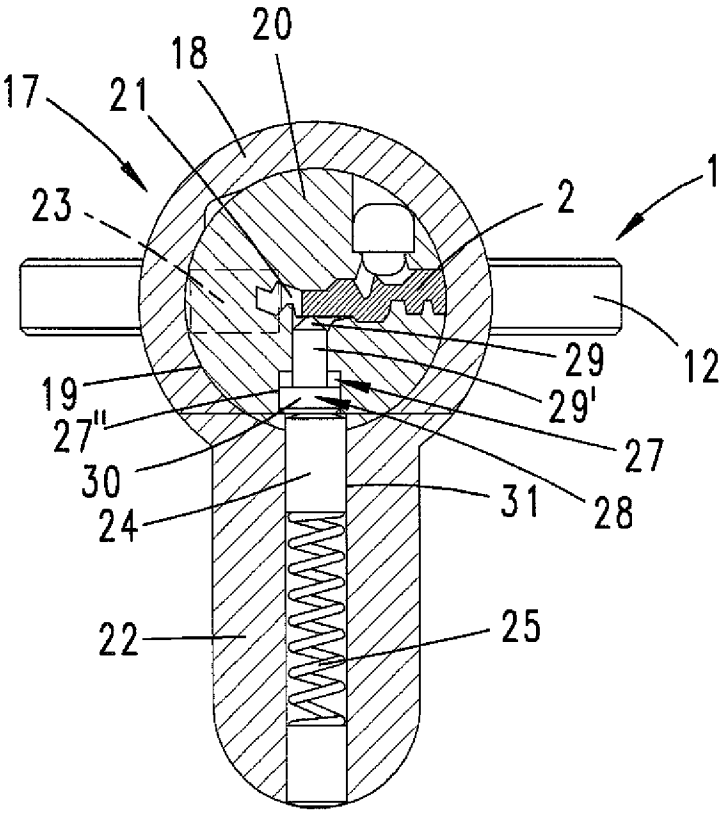
FIG. 6 shows an illustration according to FIG. 4 with a key according to FIG. 5 and with a captured housing pin 24.
Figure 5:
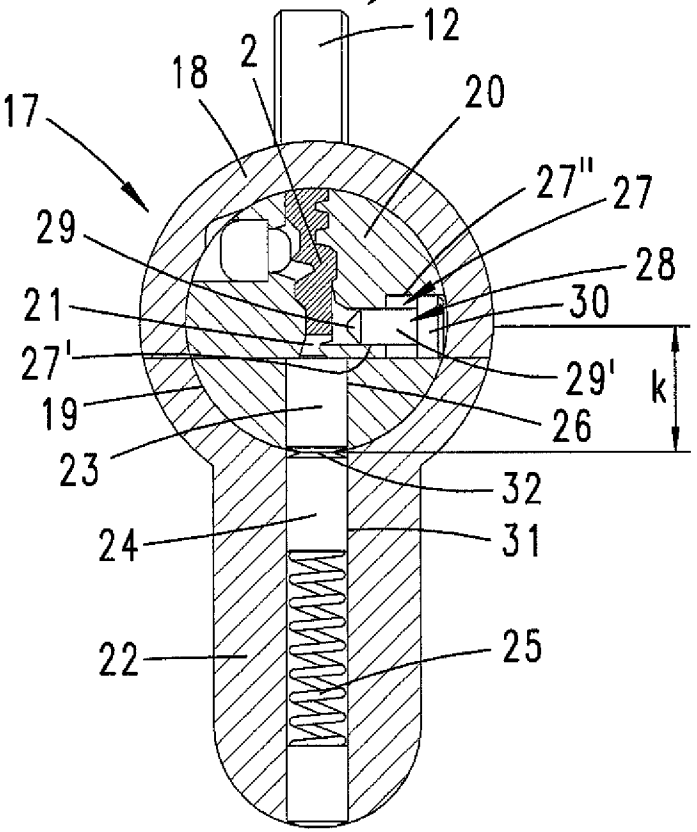
FIG. 5 shows an illustration according to FIG. 3 but with a key without a profiled rib 16.

However, if a key without a rib 16 is inserted into the keyway 21, the operating position illustrated in FIG. 6 is reached after rotation through 90° in the clockwise direction. In this position, the housing pin 24 can enter the core hole 27" and is captured there. The core cannot be rotated further out of this position.

If the key illustrated in FIG. 1 is changed to the effect that the coding notch 6*b* is deepened, so that the two peripheral edges 11' meet at an apex 6' which is at the dimension s from the spine 3, this key no longer has a sensing point 7. Said sensing point was located in the material which has been removed. If, using a key which has been prepared in this way or using a key in which all the coding notches 6*a* to 6*f* have been cut-in to the dimension s or r, an attempt is made to actuate the lock cylinder, the supplementary tumbler pin 28 cannot therefore be moved to the above-described correct position or held there.

Figure 8:
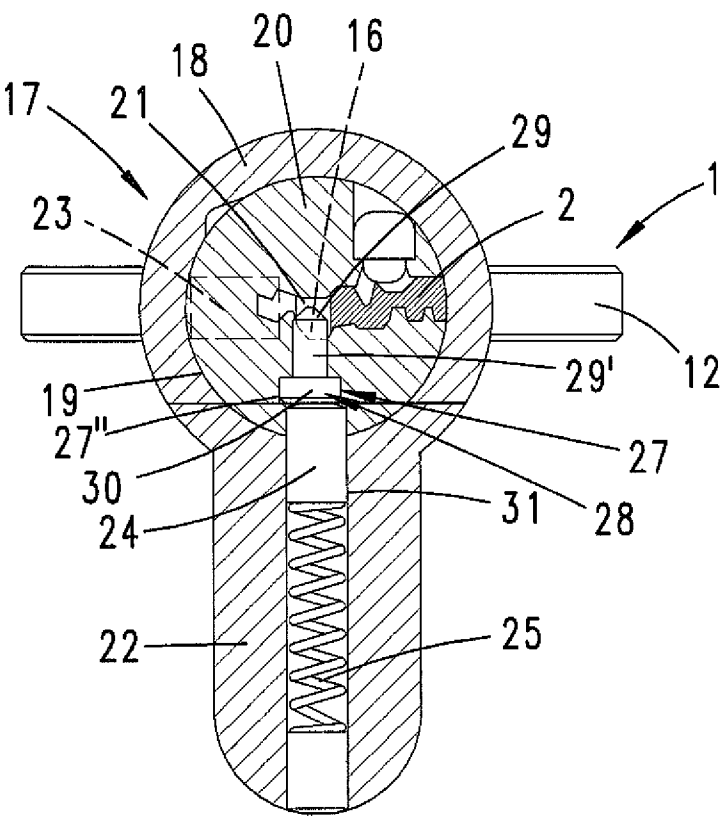
FIG. 8 shows an illustration according to FIG. 4 with a key according to FIG. 7 and with a captured housing pin 24.
Figure 7:
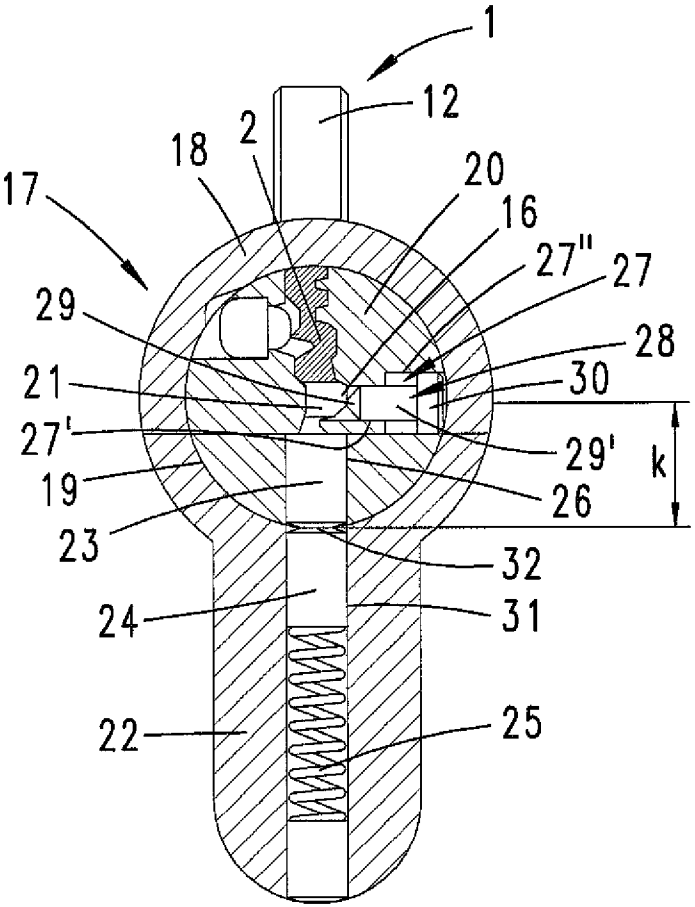
FIG. 7 shows an illustration according to FIG. 3 with a key inserted, in which however the coding notch 6*b* has been deepened to the level of the dashed line 10 in FIG. 1.
Figure 9:
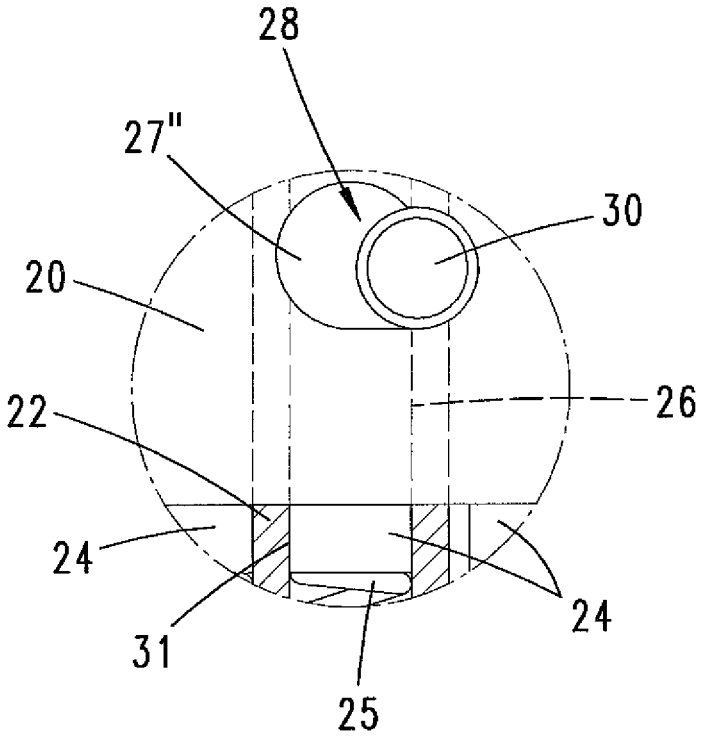
FIG. 9 shows the detail IX from FIG. 2.

If the bump opening method is used with a key which has been prepared in this way and the housing pin 24 is moved to a release position, the cylinder core 20 can be rotated through 90° to the position illustrated in FIG. 8 but, since the supplementary tumbler pin 28 is not held in its correct position, the head 30 can enter the core hole 27". A capturing free space is created for entry of the housing pin 24 as soon as the housing-pin hole 31 for said housing pin has been moved to a position in which it is aligned with the core hole 27" which forms a capturing hole.

In one exemplary embodiment (not illustrated), the capturing hole 27" can be formed such that the housing pin 24 which enters the capturing hole 27" has only the function of blocking further rotation. However, the cylinder can then be rotated back again by providing a bevel or the like.

All features disclosed are (in themselves) pertinent to the invention. The disclosure content of the associated/accompanying priority documents (copy of the prior application) is also hereby incorporated in full in the disclosure of the application, including for the purpose of incorporating features of these documents in claims of the present application. The subsidiary claims characterize, in their optionally subordinated wording, independent inventive developments of the prior art, in particular in order to file divisional applications based on these claims.

The invention claimed is:

1. A locking arrangement, comprising:

a lock cylinder; and a matching key, the key having a flat key bit with a narrow spine, two broad sides which run substantially parallel to one another, and coding notches on a front, which is opposite the spine, at coding positions on the key bit, the lock cylinder having a cylinder housing, a cylinder core which is mounted in a bearing hole in the cylinder housing and which has a keyway for insertion of the key bit, tumblers which are located in core pin holes, which interact with the coding notches on the key bit, and which are disposed at coding positions on the cylinder, the coding positions coinciding with coding positions on the key bit when a locking bit is inserted as far as a stop in the keyway, and a sensing member which is located in a supplementary core hole that extends transversely relative to the core pin holes and senses a sensing point on a broad side of the key, a spacing, from the spine, of the sensing point on a broad side of the key being greater than the spacing, from the spine, of an apex of the coding notch that is cut-in to a deepest extent, the sensing point on the broad side of the key being situated close to a peripheral edge of the coding notch which is cut-in to a lesser extent than the coding notch that is cut-in to the deepest extent in such a way that deepening, of the coding notch which is cut-in to the lesser extent, to a depth of the coding notch that is cut-in to the deepest extent leads to disappearance of the sensing point from the broad side of the key so that the sensing point is located in the coding notch, wherein the supplementary core hole is arranged between two immediately adjacent core holes and the sensing member has a tip by means of which the sensing point on a broad side of the key situated between two immediately adjacent coding positions is sensed, wherein the coding notches each have an inward apex with the coding position at which the tumbler is located, the coding notches each having two liner flanks that are substantially parallel to the flanks of the other coding notches so that an angle of the two linear flanks of each coding notch is uniform for all the notches.

2. The locking arrangement according to claim 1, wherein the sensing point is associated with a profiled rib.

3. The locking arrangement according to claim 1, wherein the sensing member is a pin which is guided in the core hole, at least regions of a pin opposite from the tip being situated in an opening which can be brought into an overlapping position with respect to a housing-pin hole and has a shape in cross-section that allows entry of a housing pin disposed in a housing hole.

4. The locking arrangement according to claim 1, wherein, when the sensing point disappears or when a width of the key is reduced in a region of the sensing point, a housing pin, which is mounted in a housing-pin hole, butts against a blocking step or is captured, when the cylinder core rotates.

5. A lock cylinder for a locking arrangement, according to claim 1, comprising:

a cylinder housing which has a cylinder core that is mounted in a bearing hole in the cylinder housing and has a keyway for insertion of a key bit of a key;

core pins, which are disposed at coding positions on the cylinder and are situated in core pin holes that are open to the bearing hole, for entry into coding notches of the key bit; and a sensing member for sensing a sensing point on a broad side of the key, spacing of a sensing end of the sensing member from an opening in the bearing hole for the core pin hole being less than the length of a longest core pin, wherein the sensing end is a tip and is located between two immediately adjacent core pins relative to an axis of rotation of the cylinder core.

6. The lock cylinder according to claim 5, wherein the sensing member is a pin which is guided in a core hole, at least regions of a head of the pin opposite from the tip is situated in an opening, which is open at the bearing-hole end and can be brought into an overlapping position with respect to a housing-pin hole, and has a shape in cross-section which allows entry of the housing pin that is disposed in the housing-pin hole, the pin which is held by the sensing point preventing entry of the housing pin into the opening by way of the end face of the head of the pin in a cylindrical lateral surface of the cylinder core.

7. The locking arrangement according to claim 1, wherein the cylinder core hole has a defined depth that defines a deepest extent of a coding notch and a distance from the key spine to a bottom of the coding notch, wherein the distance is smaller than the distance of the deepest coding notch.

8. The locking arrangement according to claim 7, wherein the sensing point has a distance from a spine of the locking bit that is greater than the distance of the deepest coding notch and the distance from the key spine to the bottom of the coding notch.

9. The locking arrangement according to claim 1, wherein a distance of the sensing point to a peripheral edge of the coding notch is such that it disappears when the coding notch is manipulated, and a new edge runs parallel to the peripheral edge and an apex of the manipulated notch has a distance to the key spine.

10. A locking arrangement, comprising:

a locking cylinder; and a matching key;

the key having a flat key bit with a narrow spine, two broad sides which run substantially parallel to one another, wherein the key bit has a plurality of coding notches on a front, which is opposite to the spine, at first coding positions, wherein each of said coding notches has an inward apex, and first and second flanks, wherein said first flanks are substantially parallel to one another, and said second flanks are substantially parallel to one another so that an angle of first and second flanks is uniform for all coding notches, wherein the coding notches comprise a deepest cut-in coding notch, wherein the deepest cut-in coding notch defines a first spacing which is a distance from the spine to the apex of the deepest cut-in coding notch;

wherein the locking cylinder has a cylinder housing, a cylinder core which is mounted in a bearing hole in the cylinder housing and which has a keyway for insertion of the key bit, tumblers which are located in core pin holes, which interact with the coding notches on the key bit, and which are disposed at second coding positions on the cylinder, the second coding positions coinciding with the first coding positions on the key bit when the locking bit is inserted as far as a stop in the keyway, and a sensing member which is located in a supplementary core hole that extends transversely relative to the core pin holes and senses a sensing point on a broad side of the key, wherein a distance of the sensing point to the spine defines a second spacing that is greater than the first spacing;

wherein the supplementary core hole is arranged between two immediately adjacent core pin holes and the sensing member has a tip that senses the sensing point on a broad side of the key situated between two immediately adjacent coding positions;

wherein the sensing point is situated close to a peripheral edge of a coding notch which is cut-in to a lesser extent than the coding notch that is cut-in to the deepest extent in such a way that deepening the coding notch which is cut-in to the lesser extent to a depth of the coding notch that is cut-in to the deepest extent leads to disappearance of the sensing point from the broad side of the key.

* * * * *